US006951300B2

(12) United States Patent
Caille et al.

(10) Patent No.: US 6,951,300 B2
(45) Date of Patent: Oct. 4, 2005

(54) DISPLAY PACKAGING

(75) Inventors: Gilles Caille, Paris (FR); Stéphane Graillat, Paris (FR)

(73) Assignee: Societe de Prospection et d'Inventions Techniques Spit, Bourg les Valence (FR)

( * ) Notice: Subject to any disclaimer, the term of this patent is extended or adjusted under 35 U.S.C. 154(b) by 52 days.

(21) Appl. No.: 10/345,200

(22) Filed: Jan. 16, 2003

(65) Prior Publication Data

US 2003/0146270 A1 Aug. 7, 2003

(30) Foreign Application Priority Data

Jan. 17, 2002 (FR) ..... 02 00529

(51) Int. Cl.[7] ..... B65D 5/54; B65D 5/63
(52) U.S. Cl. ..... 229/121; 229/122.1; 229/242
(58) Field of Search ..... 229/162.3, 162.6, 229/118, 121, 122.1, 164, 242; 221/305

(56) References Cited

U.S. PATENT DOCUMENTS

| | | | | | |
|---|---|---|---|---|---|
| 2,886,232 | A | * | 5/1959 | Leone | 229/122.1 |
| 3,300,115 | A | * | 1/1967 | Schauer | 221/305 |
| 3,346,167 | A | * | 10/1967 | Schmidt | 229/121 |
| 3,370,776 | A | * | 2/1968 | Krzyzanowski | 229/242 |
| 3,568,911 | A | * | 3/1971 | Bebout | 229/122.1 |
| 3,782,621 | A | * | 1/1974 | Edgeington et al. | 229/162.6 |
| 3,971,504 | A | * | 7/1976 | Whyte | 229/118 |
| 4,318,474 | A | * | 3/1982 | Hasegawa | 229/242 |
| 5,415,343 | A | * | 5/1995 | Vosbikian | 229/162.3 |
| 5,813,597 | A | * | 9/1998 | Wakevainen | 229/121 |
| 6,062,424 | A | | 5/2000 | Simile-Gravina et al. | |
| 6,073,760 | A | | 6/2000 | Roemer et al. | |

FOREIGN PATENT DOCUMENTS

| | | |
|---|---|---|
| DE | 196 19 275 A1 | 11/1997 |
| DE | 299 07 411 U1 | 9/1999 |
| GB | 2 281 065 A | 2/1995 |
| GB | 2 319 241 A | 5/1998 |

* cited by examiner

*Primary Examiner*—Gary E. Elkins
(74) *Attorney, Agent, or Firm*—Lowe Hauptman & Berner, LLP

(57) ABSTRACT

A packaging forming a parallelepipedal display unit includes a first opening element forming a display opening disposed on a first side and a second opening element forming a second display opening disposed on a second side intersecting with the first side. The display unit is usable in one of at least two distinct positions after detaching one or the other of the first and second opening elements. An information label is disposed astride the intersection of the first and second sides and on the two adjacent sides.

5 Claims, 2 Drawing Sheets

DISPLAY PACKAGING

FIELD OF THE INVENTION

The invention relates to the field of packagings, in particular to that of packaging made of cardboard or some other similar material.

BACKGROUND

For the transport of objects of all sizes, packagings in the form of boxes assembled from a cardboard blank are commonly used. In the present invention, interest is focused upon boxes for the transport of loose objects, for example of articles used in the field of construction or do-it-yourself, such as pins or screws, possibly packed in units of sale. These might be sachets or boxes containing the parts. When these objects are transported in order to be put on sale in sales outlets, provision is made to transform the boxes directly into a display case. To this end, the box comprises a pre-cut zone which has only to be separated from the rest to free an opening and provide access to the contents. Thus, in the case of a parallelepipedal shape, the box is transformed, for example, into a case by an oblique cut, parallel to one edge. After the corner has been torn off, the box is deposited on a shelf, with the opening, thus formed, facing upwards. The objects which it contains are therefore available for sale. This solution has the advantage of providing a large opening for good accessibility. In a shop or store, the box is left on its shelf until its contents are exhausted.

Other forms of opening are also known. For example, the cardboard on one face of the box can simply be cut so as to form a leaf which can pivot about a hinge. This leaf has the advantage of being able to re-close the box for possible re-transportation. In a more elaborate solution, two side cheeks are adjoined to the leaf, which allow the leaf to be held in open position and the products to be held in the pivotal drawer thus formed. Such a box can be shelved, but it can also be moved with a lesser risk of its contents spilling on the ground if the box is placed in an inclined position.

Whatever the form of the opening, the manufacturer has a need to advertise information relating to its contents on a face which remains visible when the box is placed in display position.

Where the manufacturer produces a number of different articles to be packed in identically shaped boxes, it is convenient to use labels which are stuck onto the face which remains visible.

It would be desirable to be able to have use of a packaging having a plurality of possible display unit configurations, yet the manufacture of which remains simple.

SUMMARY

The present invention achieves this object with a packaging forming a parallelepipedal display unit made of cardboard or some other similar material, characterized in that it comprises a first opening means and a second opening means disposed on either side of a first edge, allowing use as a display unit in one of at least two distinct positions following the detachment of one or other of the said means.

According to another characteristic, the first means is defined by a rupture line by which a section of the box is detached. In particular, the section of the box comprises an edge adjacent to the first edge.

According to another characteristic, the second means is formed by a drawer. In particular, the drawer is articulated about the adjacent edge opposite to the first means. More particularly, it comprises two side cheeks.

The present invention is particularly of interest in allowing an information label to be affixed astride the said first edge and onto the two faces adjacent to the latter.

The present invention also relates to a sheet of cardboard comprising a central panel and suitably cut and grooved for the realization of the said packaging, in which the first opening means and the second opening means have been arranged in continuation the one of the other on the central panel.

BRIEF DESCRIPTION OF THE DRAWINGS

A non-limiting embodiment of the invention is described below with reference to the appended drawings, in which.

DETAILED DESCRIPTION OF THE DRAWINGS

Figure 1:
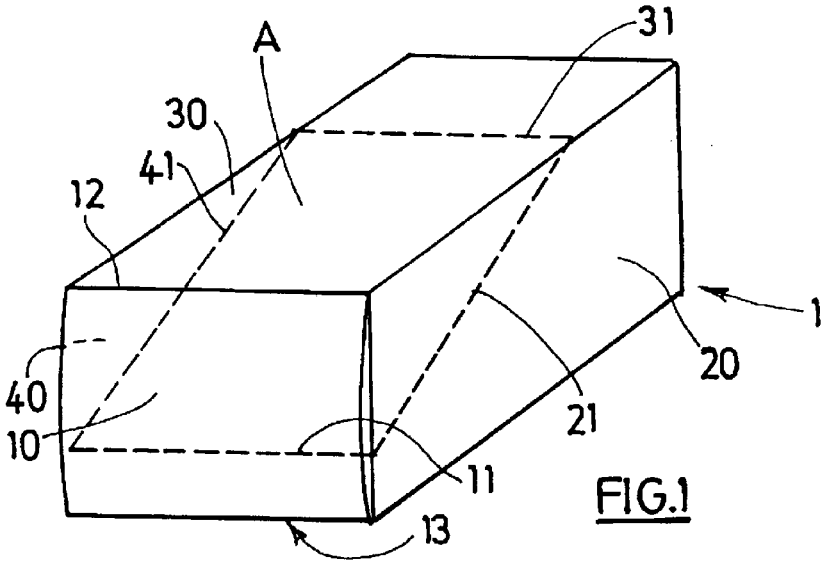
FIG. 1 shows a box having a cut for forming a display case.

A box 1 made of cardboard, flat or corrugated, or from some other similar semi-rigid material is shown diagrammatically in FIG. 1. Its form is parallelepipedal. As is known, one of its faces at least comprises a leaf 10 for loading of the box. This leaf is linked to a first edge 13 forming a hinge and comprises a detachable fastening means on the border forming the opposite edge 12. The dotted line defines a first opening means which allows the transformation of the box into a display case once the upper section A of the box comprising the edge 12 has been detached. For the easy realization of this opening, provision is made for the arrangement of a preferential rupture line in the cardboard by perforating the corresponding faces of the box, for example along lines of dots or dashes separated by tenons. That is well known.

Figure 2:
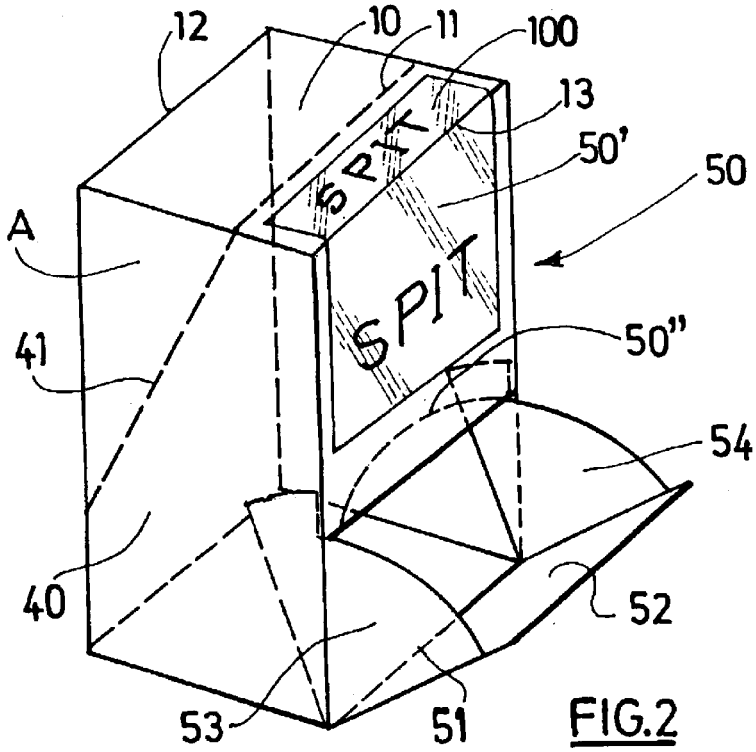
FIG. 2 shows a box according to the invention.

FIG. 2 shows the box of the invention having a second opening means on the face 50 comprising the edge 13. This opening means is in the form of a drawer articulated about the edge 51 opposite to the edge 13. It comprises a panel 52 articulated about the edge 51 and which forms a moveable section of the face 50. On each side of the panel, a cheek 53 and 54 respectively delimits the drawer laterally. These cheeks are in the form of a circular are centered upon the edge 51. The upper border comprises a rear section 53', 54' respectively, of a height superior to the opening to form an opening limit stop. The face 50 therefore comprises a fixed section 50' and a detachable section, the leaf 52. In order to make gripping of the leaf border 52 easier, a rounded pre-cut line is provided so that, by tearing-off, a space can be freed which allows fingers to pass into the box at the opening. Pulling on the leaf 52 causes this to pivot about the edge 51 to the point where the limit stops 53' and 54' come to bear against the rear of the face 50'.

As can be seen in the figure, the line 11, 21, 31, 41 has been realized, along which the first opening of FIG. 1 can be defined.

It will be seen that the position according to FIG. 1 is converted to the position of FIG. 2 by means of a 9020 pivot about the edge 51.

In one position or the other, an information label 100 can be read. This label straddles the edge 13. When the box is in the position shown in FIG. 2, the visible part of the label is on the upper section of the front face 50. When the box is in the position shown in FIG. 1, the visible part of the label is on the lower section of the front face 10.

Figure 3:
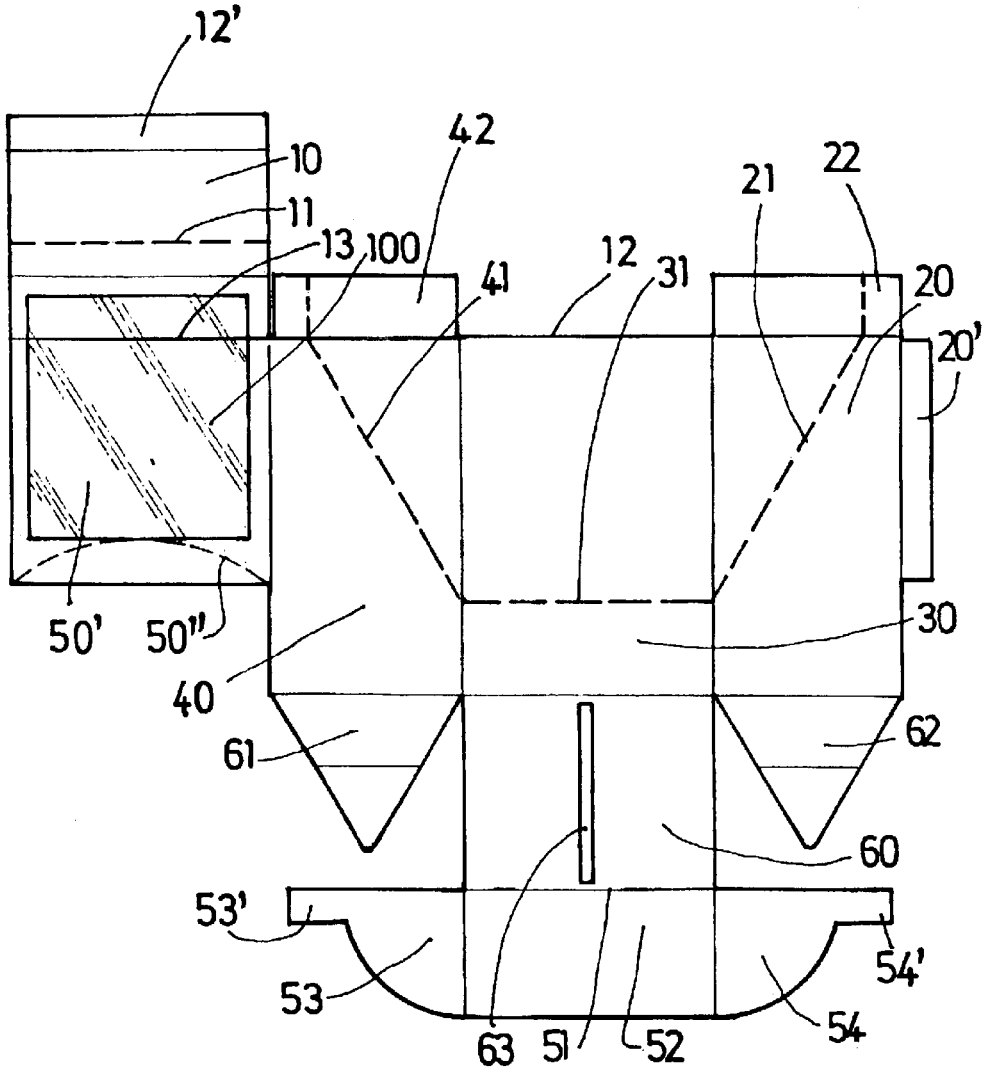
FIG. 3 represents a cardboard blank cut to realize the box of FIG. 2.

FIG. 3 shows a cardboard blank, suitably cut and grooved for realizing the box of the invention; it corresponds substantially to the developed surface of the packaging of FIGS. 1 and 2. The central panel 30 is bordered laterally by the panels 20 and 40. The latter comprises a side common with the panel 50', the height of which is less than that of the panel 40. The panel 50' is continued upwards, relative to the direction of the figure, by the panel 10. They are separated by the groove, a line marked by flattening of the cardboard, 13. At the opposite end, the panel 10 comprises a leaf 12'. The panel 30 comprises an upper border 12. It is continued at the opposite end by a panel 60, which, itself, is bordered by the panel 52 and comprises a slit 63 perpendicular to the edge 12. Two panels in the shape of a circular arc 53 and 54 border the panel 52. Panels 61 and 62 form a continuation of the panels 20 and 40. The panel 30 is pre-cut along a dotted, perforated line 31 parallel to the border 12. This pre-cut is constituted by a series of perforations separated by tenons and forms a rupture line. It is continued obliquely, on the panels 20 and 40, by two perforated lines 21 and 41. These continue onto the flaps 22 and 42 of the panels 20 and 40. A tab 20' borders the panel 20. An information label 100 has been glued onto that face of the sheet of cardboard which comes to the outside. It extends onto the panel 50' and partially onto the panel 10.

The box is erected in the following manner.

The panels 20 and 40 are folded 90° relative to the panel 30, and the panel 50' relative to the panel 40. The tab 20' is glued or clamped along the free lateral border of the panel 50'.

The panel 60 is folded down 90° and the leaves 61 and 62 are slid into the slit 63. The ends of these are folded a further 90° and are slid into appropriate slits (not represented) to form and lock the base of the box. The leaves 53 and 54 are folded down 90° and the sections 53' and 54' are slid, by forcing, behind the panel 50'. The panel 52 then forms the continuation of the panel 50'. They together form the front face 50 of the box 1. The label 100 is visible.

The box is thus ready to be filled. Once filled, the leaf 10 is folded down about the edge 13 and the tab 12' is slid inside the border 12. A locking tab (not represented) can ensure that the leaf 10 is held in the closure position of the box.

At the point of sale, the box can be placed on its face 50. The cardboard is then torn along the rupture line 11, 21, 31, and 41 and the section A removed. The free section of the panel 10, which remains around the flaps 22 and 42, is folded down to form the lower border of the case. A part of the label is clearly visible on this face.

If it is wished' to be used as a display unit, placed on the base 60-61-62, the drawer 52 is pivoted about the edge 51 to the point where the sections 53' and 54' reach their stop position.

The invention is not limited to the illustrated embodiment, it embraces all variants within the compass of the person skilled in the art, especially in terms of the form of the openings.

What is claimed is:

1. A panel for forming a parallelepipedal display unit, said panel comprising:

a central panel forming a first side of said display unit including rupture lines defining a first display opening on said first side;

a lower panel forming a second side of said display unit and abutting said central panel;

a drawer panel forming a portion of a third side of said display unit and abutting said lower panel opposite said central panel, said drawer panel forming a second display opening on said third side;

a pair of side panels forming fourth and fifth sides of said display unit and each abutting said central panel;

a face panel forming another portion of the third side of said display unit and abutting one of said pair of side panels; and an upper panel forming a sixth side of said display unit and abutting said face panel.

2. The panel as claimed in claim 1, further comprising at least one arc-shaped panel abutting said drawer panel and configured to limit said second display opening of said display unit.

3. The panel as claimed in claim 1, wherein said upper panel and said pair of side panels further include rupture lines in connection with said central panel rupture lines further defining said first display opening.

4. The panel as claimed in claim 3, wherein said first display opening defined by said rupture lines circumscribes one edge of said display unit.

5. The panel as claimed in claim 1, further comprising an information label disposed astride the abutment of said face panel and said upper panel.

* * * * *